US008056356B2

(12) United States Patent
Javerschek

(10) Patent No.: US 8,056,356 B2
(45) Date of Patent: Nov. 15, 2011

(54) REFRIGERATING PLANT

(75) Inventor: Oliver Javerschek, Herrenberg (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 918 days.

(21) Appl. No.: 11/873,039

(22) Filed: Oct. 16, 2007

(65) Prior Publication Data

US 2008/0110200 A1 May 15, 2008

(30) Foreign Application Priority Data

Oct. 17, 2006 (DE) ..... 10 2006 050 232

(51) Int. Cl.
*F25B 7/00* (2006.01)

(52) U.S. Cl. ..... 62/335; 62/498

(58) Field of Classification Search ..... 62/199, 62/200, 335, 510, 498
See application file for complete search history.

(56) References Cited

U.S. PATENT DOCUMENTS

| | | | | |
|---|---|---|---|---|
| 3,766,745 | A | 10/1973 | Quick | |
| 4,742,694 | A * | 5/1988 | Yamanaka et al. | 62/510 |
| 5,079,929 | A * | 1/1992 | Alsenz | 62/117 |

FOREIGN PATENT DOCUMENTS

| | | | |
|---|---|---|---|
| DE | 10 2004 038 640 | A1 | 2/2006 |
| WO | WO 2006/015629 | A1 | 2/2006 |
| WO | WO 2006/015741 | A1 | 2/2006 |
| WO | WO 2006015741 | A1 * | 2/2006 |

OTHER PUBLICATIONS

Translation of WO 2006015741 A1.*

* cited by examiner

*Primary Examiner* — Melvin Jones
(74) *Attorney, Agent, or Firm* — Reinhart Boerner Van Deuren P.C.

(57) ABSTRACT

In order to improve a refrigerating plant, comprising a refrigerant circuit, with a high-side refrigerant-cooling heat exchanger, with an expansion cooling device, with a reservoir for the main mass flow, with at least one normal cooling stage, with an intense cooling stage, which removes an overall intense cooling mass flow from the reservoir, and with at least one refrigerant compressor unit, which is disposed in the refrigerant circuit, in such a way that it has a better efficiency, it is proposed that the intense cooling stage has for further cooling of the overall intense cooling mass flow an intense cooling expansion cooling device, which in the active state cools the overall intense cooling mass flow and thereby produces a main intense cooling mass flow, which is fed to the intense cooling expansion element, and an additional intense cooling mass flow.

25 Claims, 5 Drawing Sheets

REFRIGERATING PLANT

CROSS-REFERENCE TO RELATED PATENT APPLICATIONS

This patent application claims the benefit of German Application No. 10 2006 050 232.9, filed Oct. 17, 2006, the teachings and disclosure of which are hereby incorporated in their entirety by reference thereto.

BACKGROUND OF THE INVENTION

The invention relates to a refrigerating plant, comprising a refrigerant circuit, in which an overall mass flow of a refrigerant is circulated, a high-side refrigerant-cooling heat exchanger, which is disposed in the refrigerant circuit, an expansion cooling device, which is disposed in the refrigerant circuit and in the active state cools the overall mass flow of the refrigerant and thereby produces a main mass flow of liquid refrigerant and an additional mass flow of gaseous refrigerant, a reservoir for the main mass flow, at least one normal cooling stage, which removes a normal cooling mass flow from the reservoir and has a normal cooling expansion element and a low-side normal cooling heat exchanger, provided downstream of said expansion element and providing refrigerating capacity for the normal cooling, an intense cooling stage, which removes an overall intense cooling mass flow from the reservoir and has an intense cooling expansion element and a downstream intense cooling heat exchanger providing refrigerating capacity, and also with an intense cooling compressor unit downstream of this intense cooling heat exchanger, and at least one refrigerant compressor unit, which is disposed in the refrigerant circuit and compresses the refrigerant of the main mass flow and of the additional mass flow to high pressure.

Such a refrigerating plant, which is suitable in particular for carbon dioxide as the refrigerant, is known from DE 10 2004 038 640 A1, the efficiency in this refrigerating plant not being optimal, in particular in connection with the intense cooling stage that is operated.

It is therefore an object of the invention to improve a refrigerating plant of the type described at the beginning to the extent that it has a better efficiency.

SUMMARY OF THE INVENTION

This object is achieved in the case of a refrigerating plant of the type described at the beginning by the intense cooling stage having for further cooling of the overall intense cooling mass flow an intense cooling expansion cooling device, which in the active state cools the overall intense cooling mass flow and thereby produces a main intense cooling mass flow, which is fed to the intense cooling expansion element, and an additional intense cooling mass flow.

The advantage of the solution according to the invention can be seen in that the intense cooling expansion cooling device has created the possibility of further increasing the amount of heat that can be taken up at the intense cooling temperature and consequently further increasing the efficiency of the refrigerating plant according to the invention, the increase in enthalpy that is possible at the intense cooling temperature by taking up thermal energy in the intense cooling heat exchanger being optimally matched to the thermodynamic states of the refrigerant, in particular the thermodynamically possible states of carbon dioxide as the refrigerant.

In particular, one embodiment provides that, for increasing the available difference in enthalpy in the heat exchanger or for further lowering the enthalpy of the main intense cooling mass flow, there is an intense cooling expansion device, which in the active state makes the overall intense cooling mass flow expand and thereby produces a main intense cooling mass flow, which is fed to the intense cooling expansion element, and the additional intense cooling mass flow.

So far no further details have been specified with regard to the intermediate intense cooling pressure that is present in the intense cooling expansion cooling device.

It is preferably provided here that the intermediate intense cooling pressure lies between the intermediate pressure in the expansion cooling device and a suction pressure of the intense cooling compressor unit, in order to adapt the lowering of the enthalpy that is possible by expansion in the intense cooling expansion cooling device optimally to the conditions of the refrigerating plant.

A suitable solution provides in this respect that, in the intense cooling expansion cooling device, the intermediate intense cooling pressure is at least approximately 2 bar lower than the intermediate pressure of the expansion cooling device.

It is still better if the intermediate intense cooling pressure is at least approximately 4 bar lower than the intermediate pressure of the expansion cooling device.

Furthermore, a suitable solution provides that, in the intense cooling expansion cooling device, the intermediate intense cooling pressure is approximately 2 bar higher than the suction pressure of the intense cooling compressor unit.

It is still better if the intermediate intense cooling pressure is at least approximately 4 bar higher than the suction pressure of the intense cooling compressor unit.

It is particularly advantageous in this respect if, in the intense cooling expansion cooling device, there is an intermediate intense cooling pressure that lies in a middle range of the pressure difference between the intermediate pressure in the expansion cooling device and the suction pressure of the intense cooling compressor unit.

A particularly suitable solution provides that, in the intense cooling expansion cooling device, there is an intermediate intense cooling pressure that lies in a middle third of a pressure difference divided into three thirds between the intermediate pressure in the expansion cooling device and the suction pressure of the intense cooling compressor unit.

So far no further details have been specified likewise with regard to the discharge of the additional intense cooling mass flow. So, for example, it would be conceivable to compress the additional intense cooling mass flow likewise by means of the intense cooling compressor unit, optionally an additional compressor stage of the intense cooling compressor unit.

However, a particularly simple solution provides that the additional intense cooling mass flow is fed to the refrigerant compressor unit, so that no compressing is performed by means of the intense cooling compressor unit.

In this respect, there would still be the possibility as before of feeding the additional intense cooling mass flow to a separate additional compressor stage of the refrigerant compressor unit.

A simplified embodiment of the refrigerating plant according to the invention provides that in it the additional intense cooling mass flow is fed to a suction connection of the refrigerant compressor unit, and consequently an additional compressor stage is not required.

In this respect, it would still be conceivable as before to set the intermediate intense cooling pressure to a desired level other than the pressure at the suction connection by means of a throttling element.

However, a simple embodiment of the refrigerating plant according to the invention provides that in it the additional intense cooling mass flow is fed to the suction connection of the refrigerant compressor unit without the pressure being regulated, and consequently no additional measures are required for the pressure regulation of the intermediate intense cooling pressure.

In the case of one embodiment of the solution according to the invention, the intermediate intense cooling pressure is suitably chosen such that it lies in the range of the low pressure at the suction connection of the refrigerant compressor unit.

In the simplest case, the intermediate intense cooling pressure corresponds approximately to the low pressure at the suction connection of the refrigerant compressor unit.

Furthermore, in the case of one embodiment of the solution according to the invention, the refrigerant compressor unit could be constructed in such a way that it has different refrigerant compressors for the normal cooling mass flow and the additional intense cooling mass flow.

A particularly simple solution provides that the additional intense cooling mass flow is fed together with the normal cooling mass flow, expanded to low pressure, to the refrigerant compressor unit, so that the refrigerant compressor unit sucks in and compresses the sum of the two mass flows.

So far no further details have been specified with regard to the further compression of the main intense cooling mass flow compressed by the intense cooling compressor unit.

This main intense cooling mass flow leaving the intense cooling compressor unit could also be fed to a separate compressor stage.

A structurally simple solution provides that the main intense cooling mass flow compressed by the intense cooling compressor unit is fed to the refrigerant compressor unit, and consequently undergoes a compression to high pressure by the refrigerant compressor unit.

The further compressing of the main intense cooling mass flow can then be performed by means of an additional compressor stage of the refrigerant compressor unit.

It is particularly advantageous if the main intense cooling mass flow compressed by the intense cooling compressor unit is mixed with the expanded normal cooling mass flow and fed to a suction connection of the refrigerant compressor unit. In this case, the mixing of the compressed, but thereby heated, main intense cooling mass flow with the expanded, but cooler, normal cooling mass flow has the effect that the enthalpy of the main intense cooling mass flow is lowered, and consequently an overall enthalpy of the compressed main intense cooling mass flow and the expanded normal cooling mass flow is obtained.

In particular, the resultant heating of the expanded normal cooling mass flow by the main intense cooling mass flow compressed by the intense cooling compressor unit has the effect that the refrigerant to be compressed by the refrigerant compressor unit is fed to the latter substantially free from liquid components, and consequently in a superheated state.

A particularly advantageous solution provides that the main intense cooling mass flow compressed by the intense cooling compressor unit, the additional intense cooling mass flow and the expanded normal cooling mass flow are mixed with one another and fed to the suction connection of the refrigerant compressor unit, and consequently all the mass flows mentioned above are compressed together by the refrigerant compressor unit.

This solution has in particular the advantage that different operating conditions, that is to say different refrigerating capacities, of the normal cooling stage and the intense cooling stage even out, at least partially, and consequently the regulating of the refrigerant compressor unit is simplified.

So far no further details have been specified with regard to the operating mode of the intense cooling expansion cooling device.

So, an advantageous solution provides that the intense cooling expansion cooling device reduces the enthalpy of the main intense cooling mass flow by at least 10% in comparison with the enthalpy of the overall intense cooling mass flow.

It is still more advantageous if the intense cooling expansion cooling device reduces the enthalpy of the main intense cooling mass flow by at least 20%.

Furthermore, in the case of an advantageous embodiment, the thermodynamic state of the main intense cooling mass flow can be established by the intense cooling expansion cooling device generating the main intense cooling mass flow in a thermodynamic state with lower pressure and enthalpy values than those of the normal cooling mass flow.

In order to obtain an optimum cooling effect at the low temperature, it is preferably provided that the pressure and enthalpy values of the main intense cooling mass flow that are brought about by the intense cooling expansion device lie near the saturation curve in the enthalpy/pressure diagram.

It is still better if the pressure and enthalpy values of the main intense cooling mass flow that are brought about by the intense cooling expansion device lie substantially on the saturation curve of the enthalpy/pressure diagram.

No further details have been specified with regard to the functioning mode of the expansion cooling device in connection with the exemplary embodiments described so far. So, an advantageous exemplary embodiment provides that the expansion cooling device has an expansion element for the expansion of the overall mass flow to the intermediate pressure and that a maximum value of the intermediate pressure can be set.

It is particularly advantageous in this respect if the intermediate pressure can be set to a maximum value of 40 bar or less, since this allows easy implementation of the pipework, at least for the normal cooling stage.

The adjustability of the setting can be achieved by an adjustability of the expansion element, so that standard components approved up to this pressure can usually be used.

As an alternative or in addition to the adjustability of the expansion element, a further advantageous exemplary embodiment provides that the intermediate pressure can be set by feeding at least part of the additional mass flow to an additional suction connection of the refrigerant compressor unit.

Such a refrigerant compressor unit provided with an additional suction connection may in this case be constructed in a wide variety of ways. One solution provides that the refrigerant compressor unit has refrigerant compressors with additional compressor stages.

However, it is also conceivable to construct the refrigerant compressor unit from a multiplicity of refrigerant compressors and thereby provide one of the refrigerant compressors for compressing the additional mass flow.

In particular, it is advantageous in this respect if the delivery capacity of the refrigerant compressor unit that is available at the additional suction connection can be set, so that the intermediate pressure can also be set via the setting of the available delivery capacity.

The setting of the delivery capacity at the additional suction connection may be adjustable either by the number of active additional compressor stages or the number of individual refrigerant compressors provided for compressing the additional mass flow and/or the speed of the same.

As an alternative or in addition to the setting of the intermediate pressure by feeding the additional mass flow to an additional suction connection of the refrigerant compressor unit, another solution provides that the intermediate pressure can be set by feeding at least part of the additional mass flow to a suction connection of the refrigerant compressor unit.

This solution has the advantage that it obviates the need to provide additional compressor stages or refrigerant compressors specifically provided for the additional suction connection, but instead the additional mass flow merely has to be directed to the suction connection of the refrigerant compressor unit used in any case for compressing the main mass flow of the refrigerant. However, this solution has a slight disadvantage with regard to reducing the efficiency.

Furthermore, when the additional mass flow is fed to the suction connection, it is necessary to provide an adjustable throttling element to allow the intermediate pressure to be set by this.

A particularly advantageous solution that substantially allows optimum operation of the refrigerating plant in all operating states and in all temperature conditions provides a controller which feeds the additional mass flow either to the additional suction connection or to the latter and in parts to the suction connection of the refrigerant compressor unit.

This allows an additional suction connection that is provided and the compressor capacity that is available at it always to be utilized, but the intermediate pressure to be kept below an adjustable maximum value in the cases in which there is a high additional mass flow, if in the case of a great additional mass flow part of the same can be fed to the suction connection of the refrigerant compressor unit.

No further details have been specified in connection with the explanation so far of the individual exemplary embodiments with regard to the functioning mode of the expansion cooling device itself.

So, an advantageous embodiment provides that the expansion cooling device reduces the enthalpy of the main mass flow by at least 10% in comparison with the enthalpy of the overall mass flow.

It is still more advantageous if the expansion cooling device reduces the enthalpy of the main mass flow by at least 20%.

With regard to the use of the expansion cooling device, it is provided in particular that the expansion cooling device is active during supercritical operation of the refrigerating plant.

Such supercritical operation obtains in particular when carbon dioxide is used as the refrigerant and there are the usual ambient temperatures for cooling the heat exchanger.

In particular, it is provided in the case of an advantageous embodiment that the expansion cooling device generates the main mass flow in a thermodynamic state with lower pressure and enthalpy values than those of a maximum of the saturation curve.

Furthermore, it is preferably provided that the pressure and enthalpy values of the main mass flow that are brought about by the expansion cooling device lie near the saturation curve in the enthalpy/pressure diagram.

It is still better if the pressure and enthalpy values of the main mass flow that are brought about by the expansion cooling device lie substantially on the saturation curve of the enthalpy/pressure diagram.

In particular to prevent the refrigerant compressor unit from sucking in refrigerant with liquid components at the suction connection, it is preferably provided that the refrigerant entering the suction connection of the refrigerant compressor unit can be heated by a heat exchanger provided upstream of it. Such a heat exchanger allows the refrigerant that is to be sucked in to be heated to the extent that liquid components are substantially ruled out, so that this refrigerant can be referred to as superheated.

Heat could be fed to the heat exchanger in a wide variety of ways.

An advantageous solution provides that the heat exchanger removes heat from the overall mass flow emerging from the high-side heat exchanger, so that the overall mass flow that emerges from the high-side heat exchanger, but is still heated, can be used for the purpose of heating the refrigerant entering the refrigerant compressor unit, in exchange at the same time for a cooling of the overall mass flow.

Further features and advantages of the invention are the subject of the following description and the graphic representation of some exemplary embodiments.

DETAILED DESCRIPTION OF THE INVENTION

Figure 1:
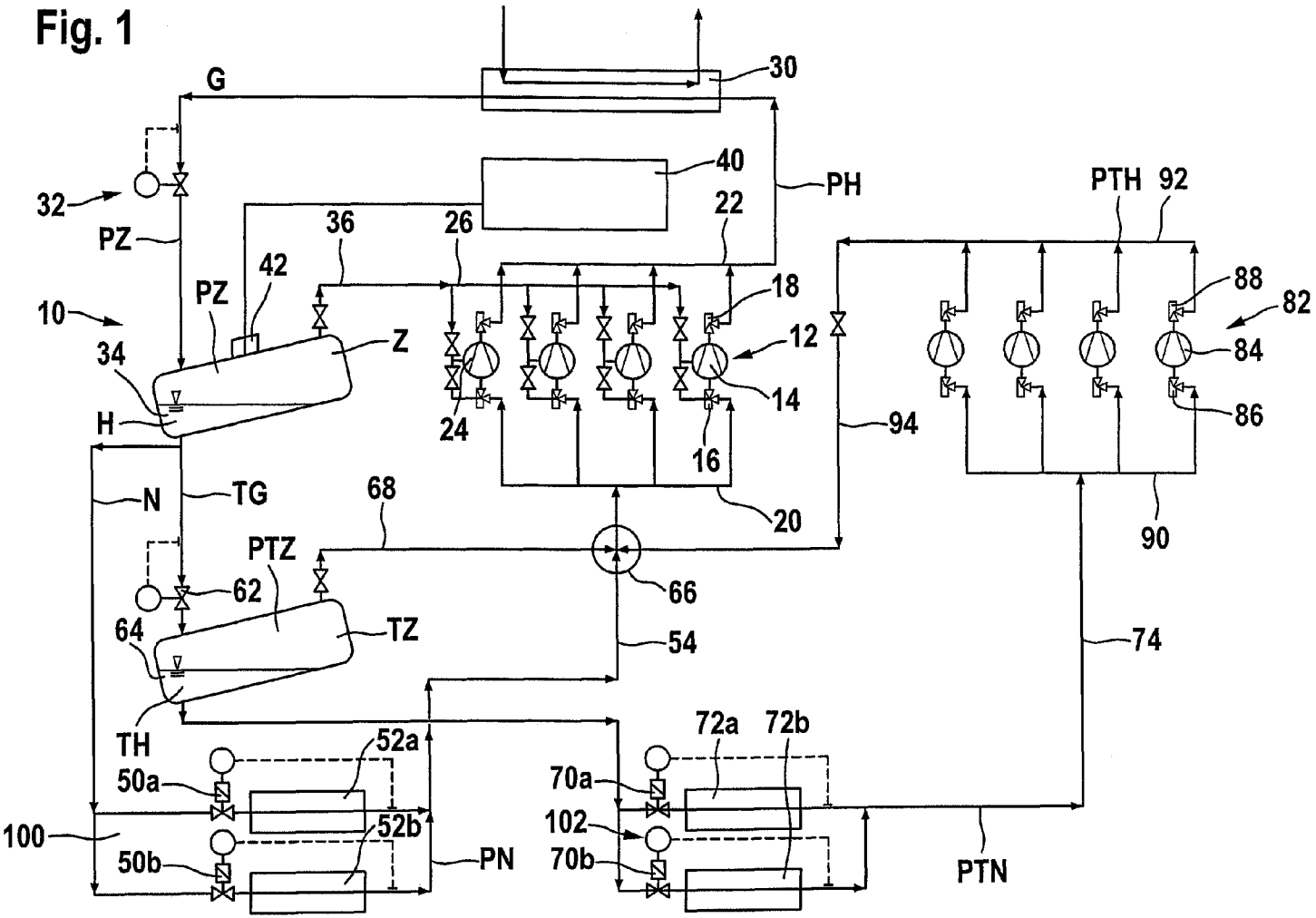
FIG. 1 shows a schematic representation of a pipework diagram of a first exemplary embodiment of a refrigerating plant according to the invention.

A first exemplary embodiment of a refrigerating plant according to the invention, represented in FIG. 1, comprises a refrigerant circuit, which is designated as a whole by 10 and in which a refrigerant compressor unit designated as a whole by 12 is disposed, comprising in the exemplary embodiment represented a number of individual refrigerant compressors 14, for example four refrigerant compressors 14.

Each of the refrigerant compressors 14 has a connection 16 on the suction side and a connection 18 on the pressure side, all the suction-side connections 16 being grouped together to form a suction connection 20 of the refrigerant compressor unit 12 and all the pressure-side connections 18 being grouped together to form a pressure connection 22 of the refrigerant compressor unit 12.

Consequently, all the refrigerant compressors 14 operate in parallel, but there is the possibility of varying the compressor output of the refrigerant compressor unit 12 by some of the refrigerant compressors 14 operating and some of them not operating.

Furthermore, there is the possibility of varying the compressor output of the refrigerant compressor unit 12 by speed-variable control of the individual refrigerant compressors 14 that are operating.

In addition, each of the refrigerant compressors 14 also has an additional connection 24, all the additional connections 24 of the refrigerant compressors being grouped together to form an additional suction connection 26 of the refrigerant compressor unit 12.

The refrigerant sucked in by the refrigerant compressor unit 12 via the additional suction connection 26 is also compressed by the unit to high pressure and emerges together with the refrigerant sucked in via the suction connection 20 and compressed to high pressure at the pressure connection 22 of the refrigerant compressor unit 12.

The refrigerant compressed to high pressure emerging at the pressure connection 22 of the refrigerant compressor unit 12 forms an overall mass flow G and it flows through a high-side heat exchanger 30, by which cooling of the refrigerant compressed to high pressure takes place.

Depending on whether a subcritical cyclic process or a supercritical cyclic process obtains, the cooling of the refrigerant compressed to high pressure in the heat exchanger 30 causes it to liquefy or merely to cool down to a lower temperature with the refrigerant remaining in the gas phase.

If carbon dioxide is used as the refrigerant, that is to say $CO_2$, under the commonly encountered ambient conditions a supercritical cyclic process usually obtains, merely involving cooling to a temperature that corresponds to an isotherm outside the dew-point and boiling-point lines or saturation curve, so that no liquefaction of the refrigerant occurs.

By contrast with this, a subcritical cyclic process provides that the heat exchanger 30 effects cooling to a temperature that corresponds to an isotherm passing through the dew-point and boiling-point lines or saturation curve of the refrigerant.

Via a pressure line 31, the refrigerant cooled down by the heat exchanger 30 is subsequently made to expand by an expansion element 32, for example an expansion valve, representing an expansion cooling device, to an intermediate pressure PZ, which corresponds to an isotherm passing through the dew-point and boiling-point lines or saturation curve of the refrigerant.

This has the effect that the overall mass flow G coming from the heat exchanger 30 and entering the expansion element 32 is transformed into a thermodynamic state in which a main mass flow H is in the form of liquid refrigerant and an additional mass flow Z is in the form of gaseous refrigerant. The two mass flows are collected in a reservoir, referred to as collector 34, and separated from one another, and the additional mass flow Z is sucked away by the refrigerant compressor unit 12 via a suction line 36 running from the collector 34 to the additional suction connection 26, the intermediate pressure PZ in the collector 34 being able to be set by the delivery capacity of the refrigerant compressor unit 12 that is available at the additional suction connection 26.

In this case, the intermediate pressure PZ is preferably set to a pressure of less than 40 bar, to allow the line and component system of the refrigerant circuit 10 that follows the collector 34 to be designed for a pressure of less than 40 bar.

To maintain the intermediate pressure PZ at a level below 40 bar, a control unit 40 is preferably provided, recording intermediate pressure PZ in the collector with a pressure sensor 42 and also capable of connecting or not connecting the individual additional connections 24 of the individual refrigerant compressors 14 to the additional suction connection 26.

For example, the refrigerant compressors 14 may be formed in a way corresponding to those of German Patent Application 10 2005 009 173.3 and be formed for example as suction-side connections of one of a number of cylinders of the respective refrigerant compressor 14, it being possible here for this cylinder to be used either for sucking in refrigerant from the additional mass flow Z via the additional suction connection 26 or for sucking in refrigerant from the expanded main mass flow fed to the suction connection 20 of the refrigerant compressor unit 12.

After the collector 34, the main mass flow H, consisting of liquefied refrigerant, is divided into a normal cooling mass flow N, which is fed to at least one normal cooling expansion element 50 or two normal cooling expansion elements 50*a*, 50*b* and also at least one normal cooling heat exchanger 52 downstream of the respective normal cooling expansion element 50.

The respective normal cooling expansion element 50 causes an expansion of the refrigerant of the normal cooling mass flow N from the intermediate pressure PZ to low pressure PN, this expansion causing cooling of the refrigerant in the normal cooling mass flow N in a known way, making it possible for heat to be taken up in the normal cooling heat exchanger 52 and thereby producing an increase in enthalpy.

The normal cooling mass flow N, made to expand to low pressure PN, is fed via a suction line 54 to the suction connection 20 of the refrigerant compressor unit 12 and is compressed by the latter to high pressure PH.

However, not only the normal cooling mass flow N but also an overall intense cooling mass flow TG is formed from the main mass flow H, and this flow TG is fed to an intense cooling expansion cooling device 62.

The intense cooling expansion cooling device 62 makes the overall intense cooling mass flow TG expand to an intermediate intense cooling pressure PTZ, so that a main intense cooling mass flow TH at a temperature lying below the temperature of the overall intense cooling mass flow TG and an additional intense cooling mass flow TZ of vaporous refrigerant are created from the overall intense cooling mass flow TG consisting of liquid refrigerant.

The main intense cooling mass flow TH and the additional intense cooling mass flow TZ are separated from one another in a reservoir that is downstream of the intense cooling expansion cooling device 62 and formed as a collector 64, the additional intense cooling mass flow TZ being discharged via a discharge line 68 leading from the collector 64 to a mixer 66.

The mixer 66 is preferably disposed in the suction line 54 and mixes the additional intense cooling mass flow TZ with the expanded normal cooling mass flow N from the at least one normal cooling heat exchanger 52, so that then both the additional intense cooling mass flow TZ and the expanded normal cooling mass flow N are mixed with one another and fed to the suction connection 20 of the refrigerant compressor unit 12.

The main intense cooling mass flow TH collecting in the collector 64 is then fed to at least one intense cooling expansion element 70, made to expand by the latter to a low intense cooling pressure PTN and fed to an intense cooling heat exchanger 72, which is downstream of the respective at least one intense cooling expansion element 70 and in which the main intense cooling mass flow TH cooled by the expansion is capable of taking up heat by increasing the enthalpy at intense cooling temperatures.

The main intense cooling mass flow TH, made to expand to low intense cooling pressure PTN, is fed via an intense cooling suction line 74, which is connected to the at least one intense cooling heat exchanger 72, to an intense cooling compressor unit 82, which for example likewise comprises a number of intense cooling compressors 84, it being possible for the individual intense cooling compressors 84 to be connected according to the required compressor output.

The intense cooling compressors 84 likewise respectively have a suction-side connection 86 and a pressure-side connection 88, the suction-side connections 86 being grouped together to form a suction connection 90 of the intense cooling compressor unit 82 and the pressure-side connections 88 being grouped together to form a pressure connection 92 of the intense cooling compressor unit 82.

The suction connection 90 of the intense cooling compressor unit 82 is in this case connected to the intense cooling suction line 74, while the pressure connection 92 of the intense cooling compressor unit 82 is connected to an intense cooling discharge line 94, which is led to the mixer 66.

The mixer 66 mixes not only the normal cooling mass flow N, made to expand to low pressure PN, and the additional intense cooling mass flow TZ, made to expand to the intermediate intense cooling pressure PTZ, but also the main intense cooling mass flow TH, compressed to a high intense cooling pressure PTH by the intense cooling compressor unit 82, so that all three mass flows N, TZ and TH are fed to the suction connection 20 of the refrigerant compressor unit 12 at the low pressure PN, which corresponds to the suction pressure at the suction connection 20, and are compressed to high pressure PH by the refrigerant compressor unit 12.

Figure 2:
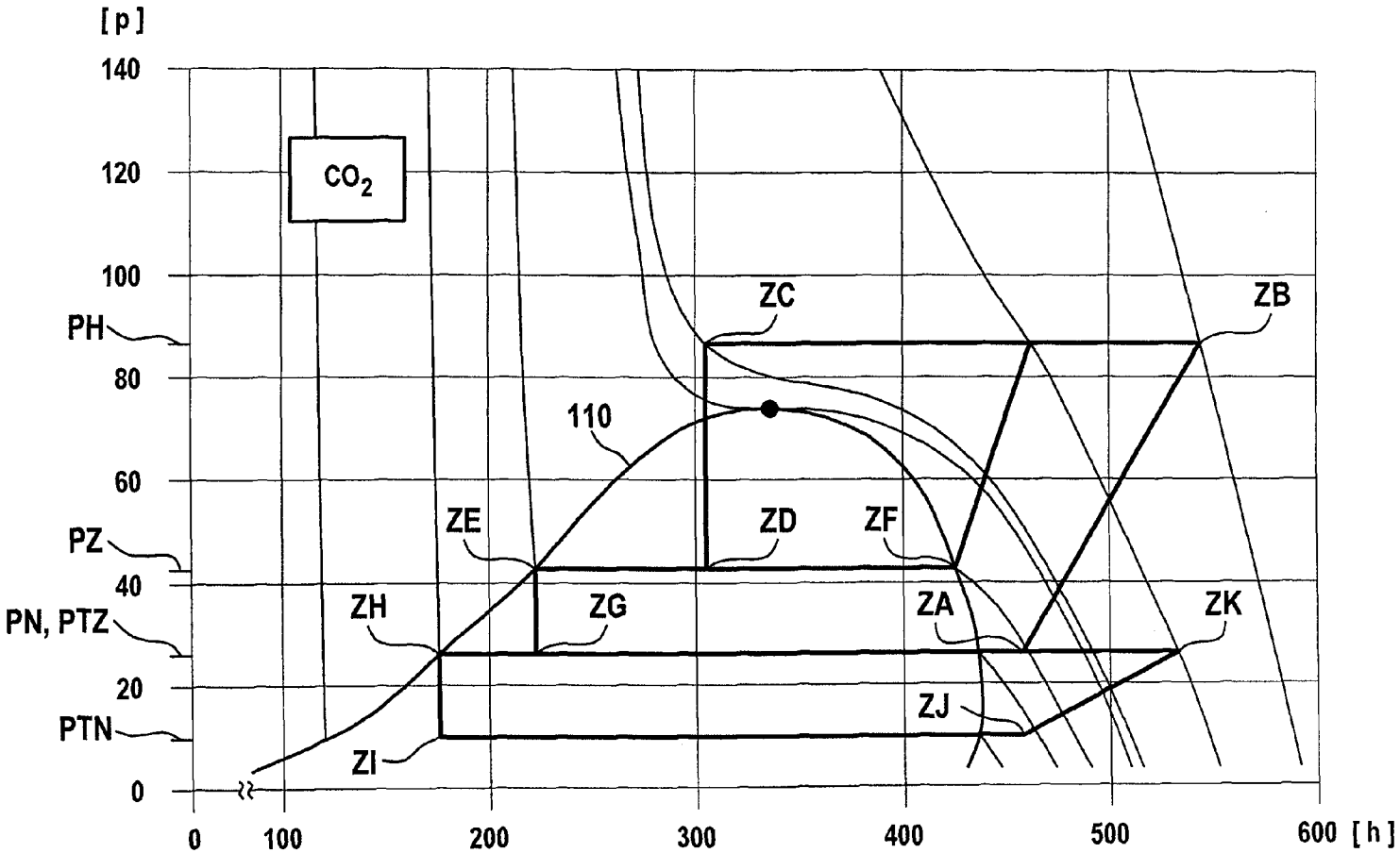
FIG. 2 shows a schematic representation of the pressure [P] against the enthalpy [h] in the case of the first exemplary embodiment of the solution according to the invention for a supercritical cyclic process according to the invention.

The supercritical cyclic process corresponding to the first exemplary embodiment is represented in FIG. 2.

The refrigerant present at the suction connection 20 of the refrigerant compressor unit 12 corresponds to the state of point ZA in FIG. 2. Compressing of the refrigerant by the refrigerant compressor unit 12 leads to an increase in pressure with a small increase in enthalpy, and consequently to the thermodynamic state ZB in FIG. 2.

After that, starting from the state ZB, the refrigerant compressed to high pressure PH is cooled while retaining the high pressure PH in the heat exchanger 30, so that after that the refrigerant is in the thermodynamic state ZC, the thermodynamic state ZC lying above the saturation curve or dew-point and boiling-point line 110 for the refrigerant, in this case carbon dioxide, so that in the thermodynamic state ZC the refrigerant is, as before, gaseous.

Starting from the state ZC, an isenthalpic expansion of the refrigerant is performed by the expansion cooling device 32 in an expansion element, or the virtually isentropic expansion is performed in an expander to the intermediate pressure PZ, and consequently into a thermodynamic state that corresponds to the point ZD and represents a mixture of a liquid phase and a gas phase, the liquid phase forming the main mass flow H in the collector 34, while the gas phase forms the additional mass flow Z.

By evaporating refrigerant to form the additional mass flow Z, which is discharged from the collector 34 via the suction line 36, the main mass flow H reaches a thermodynamic state corresponding to the point ZE with a decrease in enthalpy h that lies in the region of the saturation curve or boiling-point line, while the additional mass flow Z undergoes an increase in enthalpy on account of the enthalpy extraction from the main mass flow H to reach the thermodynamic state ZF, which lies in the region of the saturation curve or saturated vapor line or near the saturation curve or saturated vapor line, from which compressing of the additional mass flow Z to the high pressure PH again ensues, to be precise by the additional mass flow Z being sucked in via the additional suction connection 26 of the refrigerant compressor unit 12 and compressed to the high pressure PH.

Starting from the state ZE, the refrigerant from the main mass flow H is made to expand to the low pressure PN by isenthalpic expansion, on the one hand in the form of the normal cooling mass flow N by the at least one normal cooling expansion element 50 and on the other hand by the intense cooling expansion cooling device 62, the intermediate intense cooling pressure PTZ automatically adopting the pressure level of the low pressure PN at the suction connection 20 of the refrigerant compressor unit 12, provided that no special measures are taken to change this pressure.

Consequently, the refrigerant of the main mass flow H reaches the thermodynamic state corresponding to point ZG in FIG. 2 on the one hand as normal cooling mass flow N and on the other hand as overall intense cooling mass flow TG.

In the case of the normal cooling mass flow N, an increase in enthalpy takes place in the normal cooling heat exchanger, so that, after leaving the at least one normal cooling heat exchanger 52, the refrigerant of the normal cooling mass flow N reaches a preferably superheated state.

In the case of the overall intense cooling mass flow TG, the intense cooling expansion cooling device 62 and the downstream collector 64 bring about a division into a liquid phase, which forms the main intense cooling mass flow TH, which goes over into the thermodynamic state ZH in the region of the saturation curve or boiling-point line as a result of enthalpy release, and a gas phase, which forms the additional intense cooling mass flow TZ, which is fed via the discharge line 68 to the suction connection 20 of the refrigerant compressor unit 12, the additional intense cooling mass flow TZ undergoing an increase in enthalpy from the thermodynamic state ZG by enthalpy release from the main intense cooling mass flow TH, so that it reaches a thermodynamic state in the region of the saturation curve or saturated vapor line or near the saturation curve or saturated vapor line in FIG. 2.

The at least one normal cooling expansion element 50 and the normal cooling heat exchanger 52 downstream of it in this case form a normal cooling stage 100; the intense cooling expansion cooling device 62, the collector 64, the discharge line 68, the at least one intense cooling expansion element 70, the intense cooling heat exchanger 72 and the intense cooling compressor unit 82 form an intense cooling stage 102, which is integrated in the refrigerant circuit 10 and is flowed through by part of the main mass flow H, namely the overall intense cooling mass flow TG, while the normal cooling stage 100 is flowed through by the normal cooling mass flow N, ultimately both the normal cooling mass flow N and the overall intense cooling mass flow TG once again being sucked in at low pressure PN by the refrigerant compressor unit 12 via the suction connection 20 and compressed to high pressure PH, the overall mass flow G that leaves the pressure connection 22 of the refrigerant compressor unit 12 not only being made up of the normal cooling mass flow N and the overall intense cooling mass flow TG, but also additionally comprising the additional mass flow Z, which is taken up by the refrigerant compressor unit via the additional suction connection 26.

Starting from the state ZH, the refrigerant of the main intense cooling mass flow TH is fed to the at least one intense cooling expansion element 70 and undergoes in it an isenthalpic expansion to the low intense cooling pressure PTN, and consequently reaches the thermodynamic state ZI in FIG. 2.

In this thermodynamic state ZI in FIG. 2, the main intense cooling mass flow TH can take up heat by an increase in enthalpy at the intense cooling temperature in the at least one intense cooling heat exchanger 72 and thereby reach in the simplest case the thermodynamic state ZJ in FIG. 2.

In the simplest case, the state ZJ in FIG. 2 is reached by the superheat regulation of the intense cooling expansion element 70 in the intense cooling heat exchanger 72. In an actual application, an additional introduction of heat in the suction line 74 must be taken into account. Another possibility provides one or more heat exchangers between the suction line 74 and the liquid line extending from point ZI in FIG. 2.

Starting from this thermodynamic state ZJ, the main intense cooling mass flow TH, made to expand to low intense cooling pressure PTN, is compressed by the intense cooling compressor unit 82 to high intense cooling pressure PTH, corresponding to the suction pressure at the suction connection 20 of the refrigerant compressor unit 12, this compression being accompanied by an increase in enthalpy, so that the thermodynamic state ZK in FIG. 2 is reached.

By mixing the main intense cooling mass flow TH, compressed to high intense cooling pressure PTH, in the mixer 66 with the normal cooling mass flow N, which is at a lower temperature and low pressure PN, and the additional intense cooling mass flow TZ, which is likewise at a lower temperature, a decrease in enthalpy of the main intense cooling mass flow TH, compressed to high intense cooling pressure PTH, takes place in the mixer 66, so that the thermodynamic state ZA is reached by all three mass flows TH, N, TZ, starting from which compression is performed in the refrigerant compressor unit 12 to reach the thermodynamic state ZB in FIG. 2.

Figure 3:
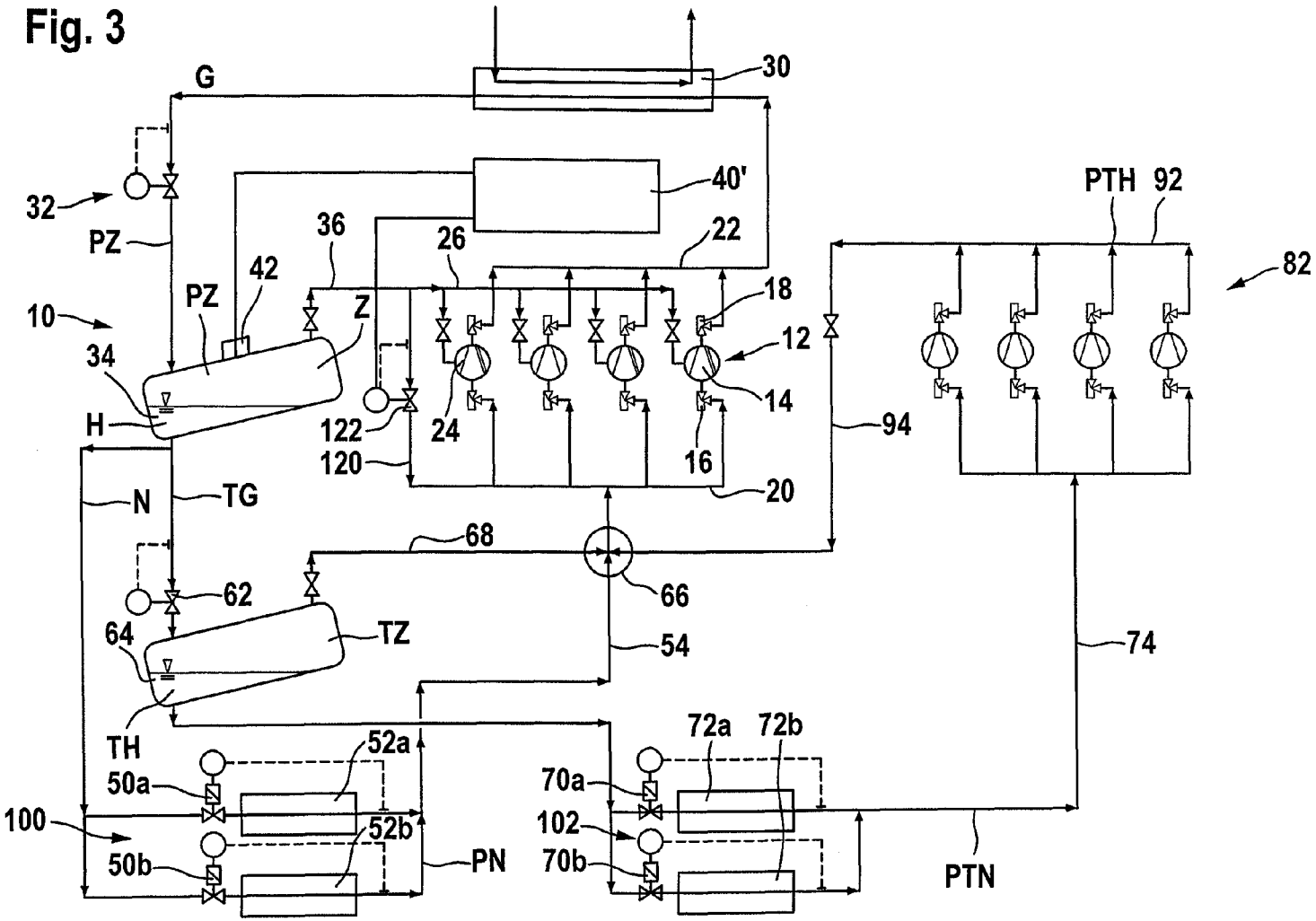
FIG. 3 shows a representation similar to FIG. 1 of a second exemplary embodiment of a refrigerating plant according to the invention.

In the case of a second exemplary embodiment of a refrigerating plant according to the invention, represented in FIG. 3, those parts that are identical to those of the first exemplary embodiment are provided with the same reference numerals, so that, with regard to the description of the same, reference can be made in full to the statements made in connection with the first exemplary embodiment.

By contrast with the first exemplary embodiment, the second exemplary embodiment also provides a connecting line 120 between the suction line 36 and the suction connection 20 of the refrigerant compressor unit 12, with a throttling element 122 that can be controlled by means of the controller 40' being provided in said line.

This provides the possibility of feeding part of the additional mass flow Z via the connecting line 120 to the suction connection 20 of the refrigerant compressor unit 12, to be precise preferably whenever the available delivery capacity at the additional suction connection 26 is exhausted and the intermediate pressure PZ controlled by the regulation 40 exceeds a set limit value. This is the case in particular in special operating states, which however do not always occur, in which the additional mass flow Z increases very strongly, so that an additional compressor delivery that is not usually required would have to be provided for this in the refrigerant compressor unit 12. For this reason, although there are sacrifices in the overall efficiency and the specific refrigerating output per delivery volume, it is made possible for the intermediate pressure PZ to be kept below 40 bar under all operating conditions.

With regard to the thermodynamic states that are passed through, the second exemplary embodiment corresponds in full to the first exemplary embodiment, so that reference is made in full to the detailed statements made in this respect in the first exemplary embodiment.

Figure 4:
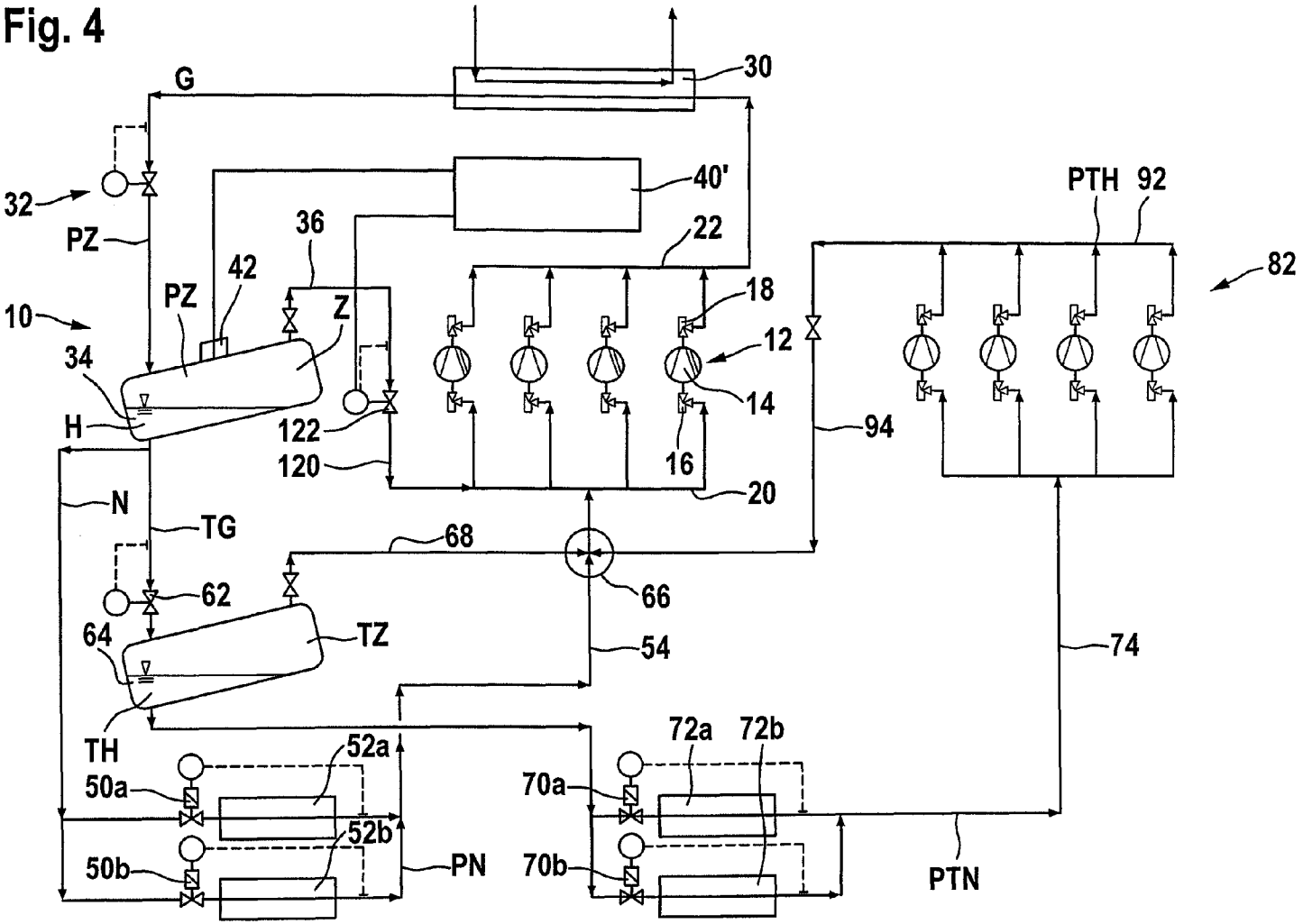
FIG. 4 shows a representation similar to FIG. 1 of a third exemplary embodiment of a refrigerating plant according to the invention and FIG. 5 shows a representation similar to FIG. 1 of a fourth exemplary embodiment of a refrigerating plant according to the invention.

In the case of a third exemplary embodiment, represented in FIG. 4, it is provided as a modification of the second exemplary embodiment that the refrigerant compressors 14 are not provided with additional connections 24, so that the refrigerant compressor unit 12 also does not have an additional suction connection 26, but instead the entire additional mass flow Z is fed to the suction connection 20 via the connecting line 120, the throttling element 122 having to be set such that the intermediate pressure PZ is higher than the low pressure PN that is present at the suction connection 20 of the refrigerant compressor unit 12.

Otherwise, with regard to the functioning mode of the third exemplary embodiment according to FIG. 4, reference is made in full to the statements made in connection with the first and second exemplary embodiments.

Figure 5:
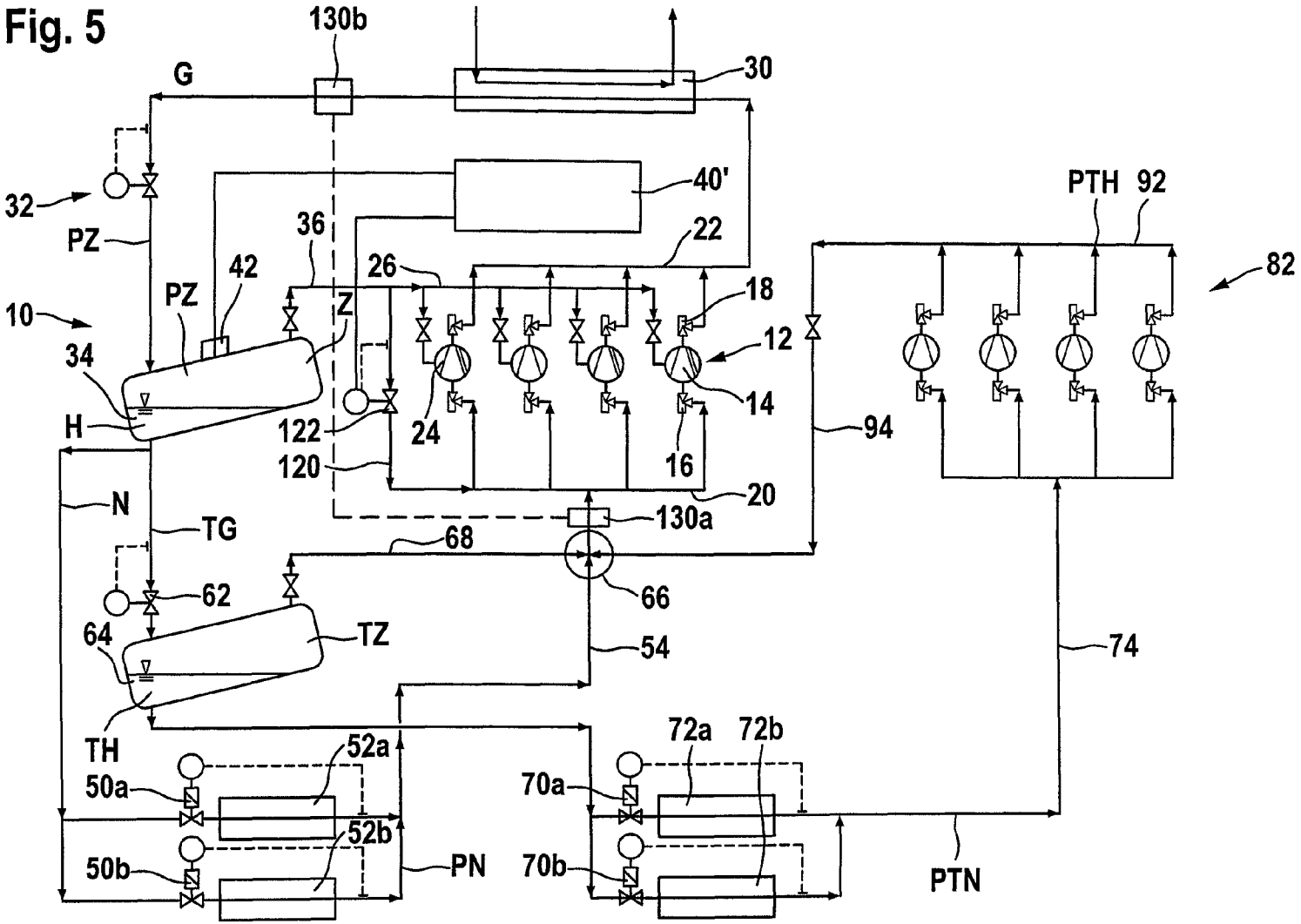

In the case of a fourth exemplary embodiment, represented in FIG. 5, as a modification of the second exemplary embodiment, a heat exchanger element **130*a* is provided in the suction line 54 between the mixer 66 and the suction connection 20 and is coupled to a heat exchanger element 130*b* in the pressure line 31, which element 130*b* is disposed between the heat exchanger 30 and the expansion cooling device 32 and is flowed through by the overall mass flow G, so that, dependent on special situations dictated by ambient temperatures and part-load conditions, there is the possibility of heating up the refrigerant fed to the suction connection 20** to the extent that it is free from liquid components.

Otherwise, with regard to the description of the fourth exemplary embodiment, reference is made in full to the statements made in connection with the first and second exemplary embodiments.

The invention claimed is:

1. A refrigerating plant, comprising: a refrigerant circuit, in which an overall mass flow of a refrigerant is circulated, a high-side refrigerant-cooling heat exchanger, which is disposed in the refrigerant circuit, an expansion cooling device, which is disposed in the refrigerant circuit and in an active state cools the overall mass flow of the refrigerant and thereby produces a main mass flow of liquid refrigerant and an additional mass flow of gaseous refrigerant, a reservoir for the main mass flow, at least one normal cooling stage, which removes a normal cooling mass flow from the reservoir and has a normal cooling expansion element and a low-side normal cooling heat exchanger, provided downstream of said expansion element and providing refrigerating capacity for the normal cooling, an intense cooling stage, which removes an overall intense cooling mass flow from the reservoir and has an intense cooling expansion element and a downstream intense cooling heat exchanger providing refrigerating capacity for the intense cooling, and also with an intense cooling compressor unit downstream of the intense cooling heat exchanger, and at least one refrigerant compressor unit, which is disposed in the refrigerant circuit and compresses the refrigerant of the main mass flow and of the additional mass flow to high pressure, the intense cooling stage having an intense cooling expansion device for further cooling of the overall intense cooling mass flow, wherein the intense cooling expansion device in the active state cools the overall intense cooling mass flow and thereby produces a main intense cooling mass flow, which is fed to the intense cooling expansion element, and an additional intense cooling mass flow.

2. The refrigerating plant according to claim 1, wherein in the intense cooling expansion cooling device there is an intermediate intense cooling pressure, which lies between an intermediate pressure of the expansion cooling device and a suction pressure of the intense cooling compressor unit.

3. The refrigerating plant according to claim 1, wherein the additional intense cooling mass flow is fed to the refrigerant compressor unit.

4. The refrigerating plant according to claim 3, wherein the additional intense cooling mass flow is fed to a suction connection of the refrigerant compressor unit.

5. The refrigerating plant according to claim 4, wherein the additional intense cooling mass flow is fed to the suction connection without the pressure being regulated.

6. The refrigerating plant according to claim 4, wherein the intermediate intense cooling pressure lies in a range of a low pressure that is experienced at the suction connection of the refrigerant compressor unit.

7. The refrigerating plant according to claim 3, wherein the additional intense cooling mass flow is fed together with the normal cooling mass flow, expanded to low pressure, to the refrigerant compressor unit.

8. The refrigerating plant according to claim 1, wherein in it the main intense cooling mass flow compressed by the intense cooling compressor unit is fed to the refrigerant compressor unit.

9. The refrigerating plant according to claim 8, wherein in it the main intense cooling mass flow compressed by the intense cooling compressor unit is mixed with the expanded normal cooling mass flow and fed to a suction connection of the refrigerant compressor unit.

10. The refrigerating plant according to claim 8, wherein in it the main intense cooling mass flow compressed by the intense cooling compressor unit, the additional intense cooling mass flow and the expanded normal cooling mass flow are mixed with one another and fed to the suction connection of the refrigerant compressor unit.

11. The refrigerating plant according to claim 1, wherein the intense cooling expansion cooling device reduces the enthalpy of the main intense cooling mass flow by at least 10% in comparison with the enthalpy of the overall intense cooling mass flow.

12. The refrigerating plant according to claim 1, wherein the intense cooling expansion cooling device generates the main intense cooling mass flow in a thermodynamic state with lower pressure and enthalpy values than those of the normal cooling mass flow.

13. The refrigerating plant according to claim 1, wherein the pressure and enthalpy values of the main intense cooling mass flow that are brought about by the intense cooling expansion cooling device lie near the saturation curve in the enthalpy/pressure diagram.

14. The refrigerating plant according to claim 13, wherein the pressure and enthalpy values of the main intense cooling mass flow that are brought about by the intense cooling expansion cooling device lie substantially on the saturation curve of the enthalpy/pressure diagram.

15. The refrigerating plant according to claim 1, wherein the expansion cooling device has an expansion element for the expansion of the overall mass flow to an intermediate pressure and in that a maximum value of the intermediate pressure can be set.

16. The refrigerating plant according to claim 1, wherein the intermediate pressure can be set by feeding at least part of the additional mass flow to an additional suction connection of the refrigerant compressor unit.

17. The refrigerating plant according to claim 1, wherein the intermediate pressure can be set by feeding at least part of the additional mass flow to a suction connection of the refrigerant compressor unit.

18. The refrigerating plant according to claim 16, wherein a controller is provided that feeds the additional mass flow either entirely to the additional suction connection or to the additional suction connection and in part to a first suction connection of the refrigerant compressor unit.

19. The refrigerating plant according to claim 1, wherein the expansion cooling device reduces the enthalpy of the main mass flow by at least 10% in comparison with the enthalpy of the overall mass flow.

20. The refrigerating plant according to claim 1, wherein the expansion cooling device is active during supercritical operation of the refrigerating plant.

21. The refrigerating plant according to claim 1, wherein the expansion cooling device generates the main mass flow in a thermodynamic state with lower pressure and enthalpy values than those of a maximum of the saturation curve.

22. The refrigerating plant according to claim 21, wherein the pressure and enthalpy values of the main mass flow that are brought about by the expansion cooling device lie near the saturation curve in the enthalpy/pressure diagram.

23. The refrigerating plant according to claim 22, wherein the pressure and enthalpy values of the main mass flow that are brought about by the expansion cooling device lie substantially on the saturation curve of the enthalpy/pressure diagram.

24. The refrigerating plant according to claim 1, wherein the refrigerant entering the suction connection of the refrigerant compressor unit can be heated by a heat exchanger provided upstream of it.

25. The refrigerating plant according to claim 24, wherein the heat exchanger removes heat from the overall mass flow emerging from the high-side heat exchanger.

* * * * *